US006421933B1

(12) United States Patent
Zamprogno

(10) Patent No.: US 6,421,933 B1
(45) Date of Patent: Jul. 23, 2002

(54) INSOLE FOR SHOES FOR SOCCER, RUNNING OR SIMILAR SPORTS

(75) Inventor: Mauro Zamprogno, Montebelluna (IT)

(73) Assignee: Lotto Sport Italia S.p.A., Montebelluna (IT)

( * ) Notice: Subject to any disclaimer, the term of this patent is extended or adjusted under 35 U.S.C. 154(b) by 0 days.

(21) Appl. No.: 09/656,863

(22) Filed: Sep. 7, 2000

(30) Foreign Application Priority Data

Oct. 12, 1999 (IT) ..... PD99A0223

(51) Int. Cl.[7] ..... A43B 13/38

(52) U.S. Cl. ..... 36/43; 36/114; 36/166; 36/155; 36/129

(58) Field of Search ..... 36/43, 44, 71, 36/140–145, 155, 166, 147, 102, 30 R, 31, 114, 129, 12, 25 R, 76 R

(56) References Cited

U.S. PATENT DOCUMENTS 1,848,518 A * 3/1932 Doran et al. ..... 36/145
3,589,037 A * 6/1971 Gallagher ..... 36/44
4,597,196 A * 7/1986 Brown ..... 36/44
5,255,451 A * 10/1993 Tong et al. ..... 36/30 A
5,713,143 A * 2/1998 Kendall ..... 36/145
5,778,561 A * 7/1998 Shimoyama ..... 36/43
5,915,820 A * 6/1999 Kraeuter et al. ..... 36/114
6,138,382 A * 10/2000 Schoesler ..... 36/43

* cited by examiner

*Primary Examiner*—Mickey Yu
*Assistant Examiner*—Jilia M Mohandesi
(74) *Attorney, Agent, or Firm*—Browdy and Neimark

(57) ABSTRACT

An insole for shoes for soccer, running or similar sports having a contoured plate-like element made of plastics, which has a first through slot composed of a transverse portion which lies ahead of the position of the line of optimum flexing of the foot, and of two longitudinal portions which protrude from the preceding portion toward the plantar arch. The insole further having a second through slot which extends from the outward region of the heel, adjacent to the plantar arch, and has a first portion directed forward, a second portion directed backward, and a wider end portion arranged in a central rear region.

7 Claims, 2 Drawing Sheets

INSOLE FOR SHOES FOR SOCCER, RUNNING OR SIMILAR SPORTS

BACKGROUND OF THE INVENTION

The present invention relates to an insole for shoes for soccer, running or similar sports.

It is known that soccer is a sport in which the shoe is highly important for correctly performing athletic movements.

The shoe is in fact primarily designed to contain the foot, especially in the rear part, but it must be particularly flexible and soft in the front part in order to avoid reducing the sensitivity of the forefoot.

The soccer shoe is also designed to act as an element for the grip of the foot on the ground and accomplishes this task by means of the studs that protrude from the tread.

In order to differentiate by regions the resistance of soccer shoes to flexural and torsional stresses, devices have been devised being constituted by inserts which are integrated in the sole or mid-sole, are arranged in a substantially median longitudinal position, and extend from the heel region up to the metatarsal region, so as to leave the forefoot free.

These inserts therefore differentiate by regions the flexibility of the sole but do not differentiate by regions the resistance to torsional stresses.

This is a significant drawback, since it has been observed that it is convenient for the shoe to provide greater torsional yielding on the inside than on the outside, in order to increase the freedom of the foot during kicking and at the same time constitute a rigid support for contrasting outward torsional movements, adequately containing the ankle.

SUMMARY OF THE INVENTION

The aim of the present invention is to provide an insole which is capable of differentiating by regions the reaction to flexural and torsional stresses of shoes for soccer, running or similar sports, so that the athletic movement can be performed in an optimum way.

Within the scope of this aim, an object of the present invention is to provide an insole having a structure which does not have a negative effect on the overall lightness of the shoe.

Another object is to provide an insole whose structure does not entail particularly significant manufacturing complications with respect to conventional insoles.

Another object is to provide an insole having a structure which can be manufactured with conventional equipment and systems.

These and other objects which will become better apparent hereinafter are achieved by an insole for shoes for soccer, running or similar sports, characterized in that it comprises a contoured plate-like element made of plastics with:

- a first through slot which is composed of a transverse portion which lies ahead of the position of the line of optimum flexing of the foot, and of two longitudinal portions which protrude from the preceding portion toward the plantar arch;
- a second through slot which extends from the outward region of the heel, adjacent to the plantar arch, and has a first portion which is directed forward, a second portion which is directed backward, and a wider end portion which is arranged in a central rear region.

BRIEF DESCRIPTION OF THE DRAWINGS

Further characteristics and advantages of the invention will become better apparent from the following detailed description of an embodiment thereof, illustrated only by way of non-limitative example in the accompanying drawings, wherein.

DESCRIPTION OF THE PREFERRED EMBODIMENTS

Figure 1:
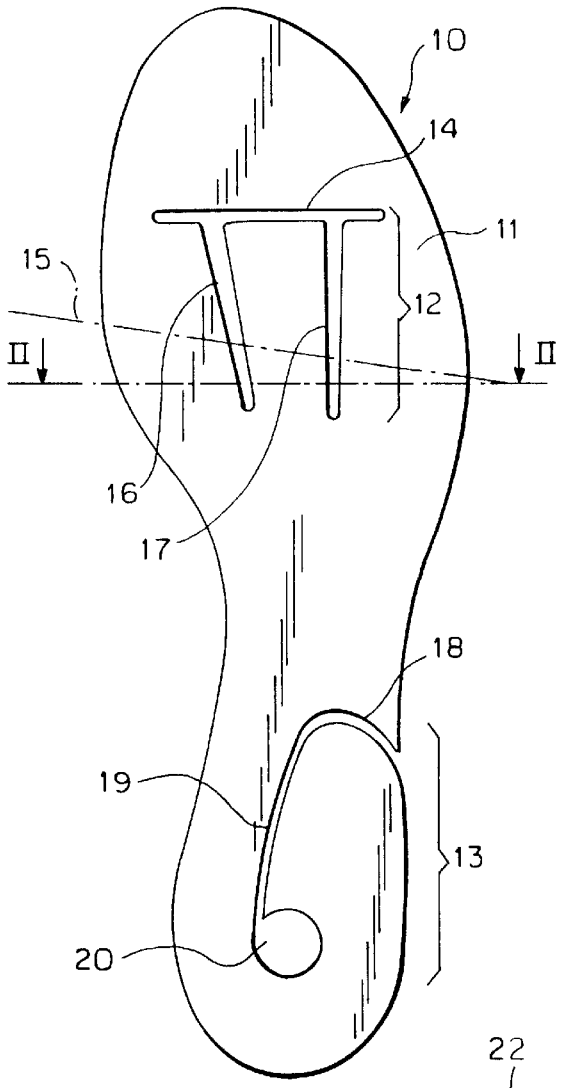
FIG. 1 is a plan view of an insole according to the present invention.
Figure 2:
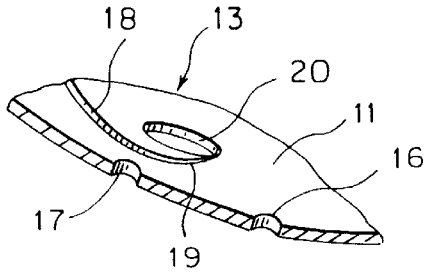
FIG. 2 is a sectional perspective view, taken along the transverse line II—II of FIG. 1.

With reference to the above figures, an insole according to the invention is generally designated by the reference numeral 10 and comprises a contoured plate-like element 11 which is made of plastics, such as for example nylon or a high-density polyurethane, and has a first through slot, generally designated by the reference numeral 12, which is located at the forefoot, and a second through slot, designated by the reference numeral 13, which is instead located in the heel region.

The first slot 12 is composed of a transverse portion 14 which lies ahead of the position of the line of optimum flexing of the foot, designated by the reference numeral 15 in the figures, and of two longitudinal portions, designated by the reference numerals 16 and 17 respectively, which protrude from the preceding portion toward the plantar arch.

The second slot 13 instead extends from the outward region of the heel, adjacent to the plantar arch, with a first portion 18 which is directed forward, a second portion 19 which is directed backward, and a wider end portion 20 which has a circular shape and is arranged in a rear central region where the heel of the foot rests.

The purpose of the first slot 12 is to move forward the flexing point by means of the transverse portion 14 and to facilitate torsion by means of the longitudinal portions 16 and 17, which allow the transverse cambering of the insole 10 in the regions where said portions are arranged.

As regards the second slot 13, it provides, for the insole 10, a structural continuity along the inward part and a discontinuity along the outward part.

This allows reaction to torsional stresses to be differentiated in these regions also.

In particular, torsions induced during kicking, an athletic movement which affects all the front inward part of the foot, are facilitated, while outward torsions are inhibited and containment of the corresponding movements of the ankle is increased.

Figure 3:
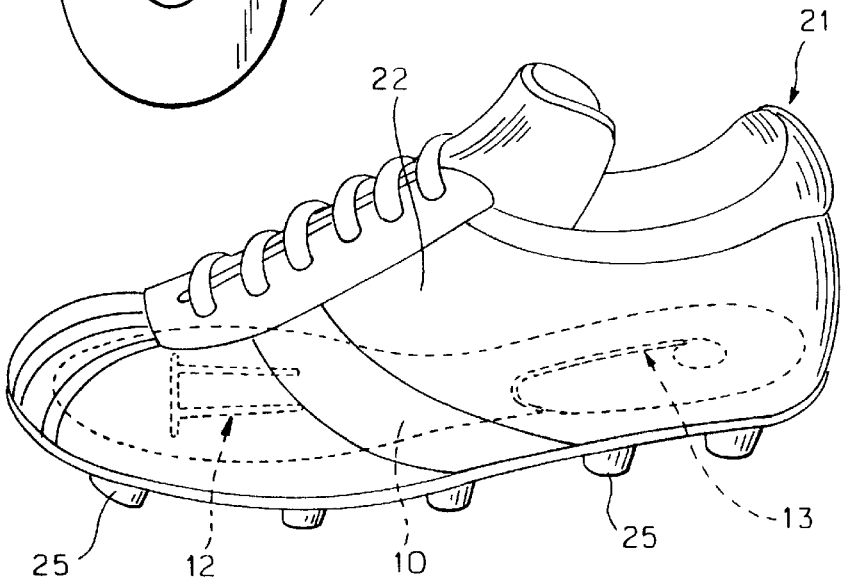
FIG. 3 is a perspective view of a soccer shoe provided with the insole of FIG. 1.
Figure 4:
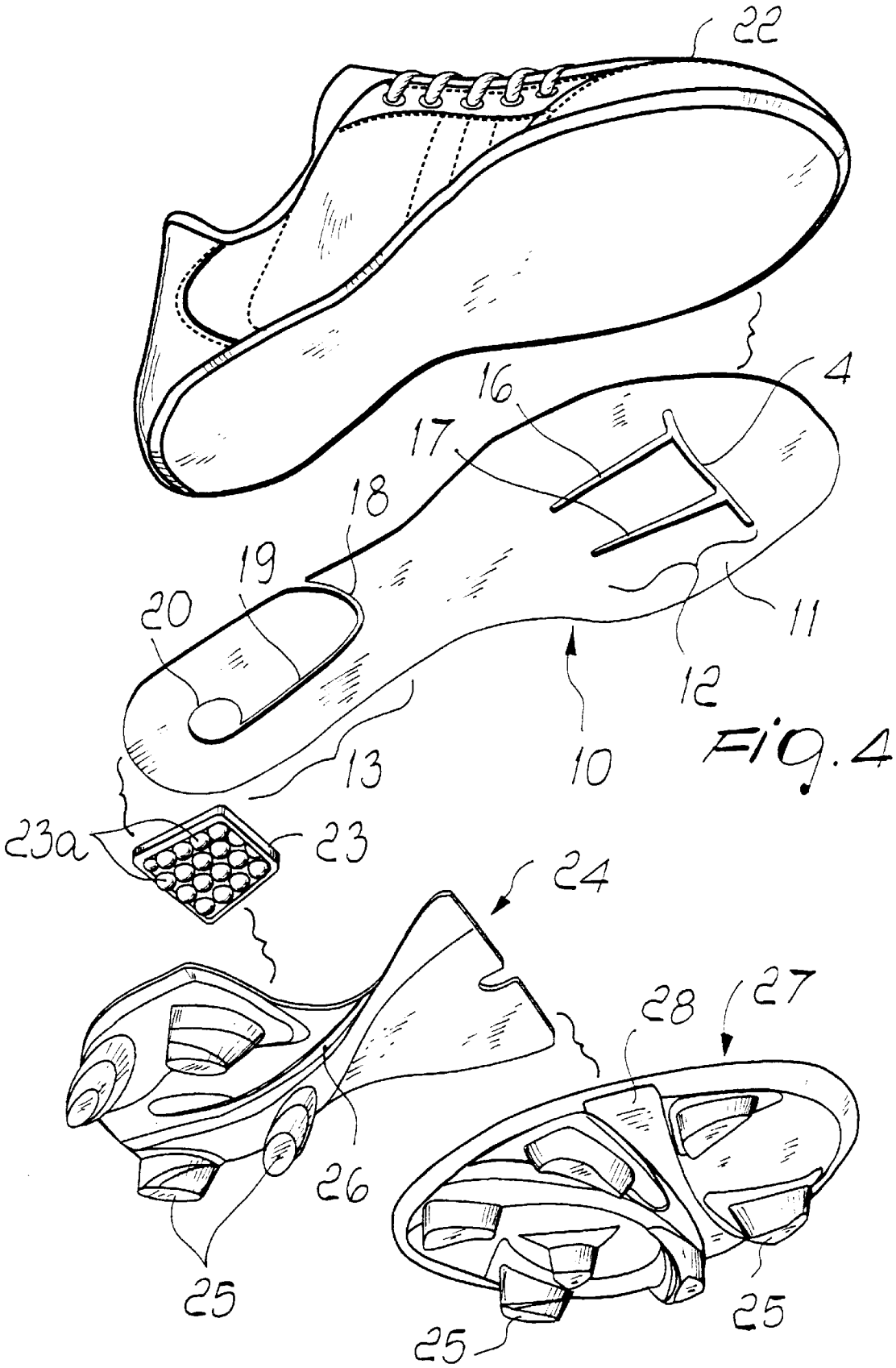
FIG. 4 is an exploded view of the shoe of FIG. 3 in the parts arranged below the upper.

With reference now in particular to the above-described FIGS. 3 and 4, such figures show the arrangement of the insole 10 in a shoe generally designated by the reference numeral 21.

The upper 22 of the shoe is assembled directly on the insole 10, for example by stitching and/or gluing, whereas a shock-absorbing element is arranged downward at the heel region; said element is constituted in practice by an elastomeric plate with a plurality of spheroidal air chambers 23*a* arranged along its entire extension.

The shock-absorbing element 23 is sandwiched between the rear part of the insole 10 and a rear sole part 24 which is made of plastics and is conveniently provided, in these cases, with studs 25.

The rear sole part 24 is conveniently provided with a channel 26 whose shape follows most of the path of the second slot 13 and can advantageously be of the through type.

The shoe is completed by a front sole part 27 which is independent of the preceding one, also has studs 25, and is provided with a transverse channel 28 which is arranged at the transverse portion 14 of the first slot 12.

In practice it has been observed that the intended aim and objects of the present invention have been achieved.

An insole has in fact been provided which achieves differentiation of the reaction to torsional stresses of the shoe without negatively affecting the overall lightness of the shoe.

The insole is constituted by a single element made of plastics which is simply provided with slots in specific regions and along specific paths, and this does not increase at all the complexity of the structure of the shoe or of the manufacturing process.

The invention thus conceived is susceptible of numerous modifications and variations, all of which are within the scope of the inventive concept.

All the details may further be replaced with other technically equivalent elements.

In practice, the materials employed, so long as they are compatible with the contingent use, as well as the dimensions, may be any according to requirements.

The disclosures in Italian Patent Application No. PD99A000223 from which this application claims priority are incorporated herein by reference.

What is claimed is:

1. An insole for a shoe -for sports that require running, comprising a contoured plate-like element made of plastics with:

a first through slot which is composed of a transverse portion which lies ahead of a line that passes through the first and second metatarsal phalangeal joints of a foot on which the shoe is worn, and of two longitudinal portions which protrude from the preceding portion toward the plantar arch; and a second through slot which extends from the outward region of the heel, adjacent to the plantar arch, and has a first portion which is directed forward, a second portion which is directed backward, and a wider end portion which is arranged in a central rear region.

2. The insole according to claim 1, wherein said wider end portion has a circular contour.

3. A shoe with an insole comprising a contoured plate-like element made of plastics with:

a first through slot which is composed of a transverse portion which lies ahead of a line that passes through the first and second metatarsal phalangeal joints of a foot on which the shoe is worn, and of two longitudinal portions which protrude from the preceding portion toward the plantar arch; and a second through slot which extends from the outward region of the heel, adjacent to the plantar arch, and has a first portion which is directed forward, a second portion which is directed backward, and a wider end portion which is arranged in a central rear region, said shoe having a sole provided in two separate parts, a front one which corresponds to said first slot and a rear one which corresponds to said second slot.

4. The shoe according to claim 3, wherein a rear part of said sole has a channel whose orientation at least partially corresponds to the path of said second slot of said insole.

5. The shoe according to claim 3, wherein said front part of the sole has a transverse channel which is arranged at the transverse portion of said first slot of said insole.

6. The shoe according to claim 3, wherein a shock-absorbing element is sandwiched between said sole and said insole at the heel.

7. The shoe according to claim 6, wherein said shock-absorbing element is constituted by an elastomeric plate which has a plurality of air chambers arranged along its entire extension.

* * * * *